United States Patent [19]

Shishido

[11] Patent Number: 4,742,954

[45] Date of Patent: May 10, 1988

[54] POSTAL CARD

[75] Inventor: Shigenary Shishido, Tokyo, Japan

[73] Assignee: Sayama Kako Co., Ltd., Tokyo, Japan

[21] Appl. No.: 66,624

[22] Filed: Jun. 26, 1987

[30] Foreign Application Priority Data

Jun. 28, 1986 [JP] Japan ..... 61-99670[U]

[51] Int. Cl.[4] ..... B42D 15/02

[52] U.S. Cl. ..... 229/92.8; 428/194; 428/202; 283/94; 283/100; 283/110; 283/111

[58] Field of Search ..... 428/194, 202; 229/92.8; 283/94, 98, 100, 101, 110, 111

[56] References Cited

U.S. PATENT DOCUMENTS 4,624,875 11/1986 Watanabe et al. ..... 428/202 X

*Primary Examiner*—Alexander S. Thomas

*Attorney, Agent, or Firm*—Cushman, Darby & Cushman

[57] ABSTRACT

A postal card having a cover sheet releasably bonded to the printed surface of a card substrate, comprising a card substrate on which secret contents are printed, a transparent protection film made of a thermoplastic resin bonded by means of adhesive layer to the printed surface of the card substrate, a cover sheet applied with a lamination film made of a thermoplastic resin different from the thermoplastic resin for the protection film, and a coupling layer made of the same kind of the thermoplastic resin as that for the lamination film and supplied between the protection film and the lamination film while heated to a temperature within a range from the softening point to the melting point of the resin for releasably coupling the protection film and the lamination film, in which the protection film, the coupling layer and the lamination film are firmly secured with each other at a fixing area and a releasing area is formed at another portion of the outer peripheral region.

The printed surface can usually be concealed securely by the cover sheet and can be read by removing the sheet smoothly.

8 Claims, 1 Drawing Sheet

POSTAL CARD

BACKGROUND OF THE INVENTION

1. Field of the Invention

This invention concerns a postal card and, more specifically, it relates to a postal card having a cover sheet releasably attached on a printed card substrate.

2. Description of the Prior Art

Postal cards are used most popularly among various types of mail matters for delivering simple messages or communications since they are inexpensive and easy to handle with.

However, since the messages written on a postal card can be easily read by stealth by other persons than the addressee, it is not so favored in the case of private letter. Also in the case of business communication in which the privacy of individual clients has to be protected, such as a notification of a bank balance, tax paper, etc., papers containing relevent information are usually mailed being sealed in envelopes.

Sealed letters, however, need higher cost and more complicate labors, for example, packing of papers into envelopes, sealing of envelopes, etc. as compared with postal cards, which are inegligible in government and public offices, as well as private companies where a great amount of papers are dispatched daily on mail. Particularly, as computer-controlled printers have gradually been introduced in recent years for printing such mail matters, conveniency of simple postal cards suitable to such line-printing work has now been estimated highly and the advent of those cards capable of keeping the secret of correspondence has been desired.

In view of the above, a postal card of a laminated structure in which a cover sheet is releasably appended to a card substrate on which messages are printed or written has been proposed (Japanese Utility Model Laying Open No. Sho 62-9571, Composite Attachment to Postal Card). In such a postal card, a transparent protection film is bonded to the printed surface of a card substrate and a cover sheet having a hiding power is releasably attached to the surface of the transparent film.

Thus, the printed area on the surface of the card substrate such as for the sum of bank balance is concealed by the cover sheet. Then, only when the addressee receiving the postal card releases the cover sheet, the printed content can be read through the transparent protection film.

However, this kind of releasable postal card still involves several problems in actual use.

At first, the cover sheet has to be bonded firmly so that it is never turned up from the card substrate till the postal card is finally received by the addressee. If the adhesion of the cover sheet to the card substrate is weak, it easily peels off, failing to attain the purpose of keeping written message secret, as well as post office may reject the acceptance of such troublesome mail matters.

While on the other hand, the cover sheet has to be released easily and smoothly from the card substrate by the addressee receiving the card. If the adhesion of the cover sheet is too strong, the cover sheet itself may be partially torn or the printed surface of the card substrate is plucked off upon releasing, to hinder easy and clear reading of the printed content.

These conflicting requirements may be solved, for example, by using a strong adhesive between the protection film and the card substrate while using a less strong adhesive between the cover sheet and the protection film. However, delicate formulation of adhesives is practically difficult and the prior art suggests nothing for the measure of selecting such adhesives.

The foregoing problem can substantially be overcome by introducing a technic of a so-called "pseudo-adhesion" formed at the boundary between two thermoplastic resin layers as proposed by the present inventor, for example, in Japanese Utility Model Laying Open No. Sho 61-204729 entitled as "Film with support lead". As described specifically latter, when a thermoplastic layer is extruded under melting over another kind of thermoplastic layer, two layers are adhered by "wetting" and bonded with each other after cooling. The two thermoplastic layers adhere to each other with an adequate bonding strength but can be released relatively easily. We call such a peculiar adhesion as "pseudo-adhesion" and this adhesion can be controlled optionally by varying the melting temperature of the resin and by selecting the combination of two resin materials for the layers.

SUMMARY OF THE INVENTION

Object of the Invention

It is an object of this invention to provide a postal card having a cover sheet releasably attached to conceal the printed surface of a card substrate.

Another and specific object of this invention is to provide a postal card in which a cover sheet is usually bonded firmly to a card substrate and can be released easily and smoothly from the card substrate.

The foregoing objects of the invention can be attained in accordance with this invention by a postal card having a cover sheet releasably bonded to the printed surface of a card substrate, comprising:

a card substrate on which contents or messages are printed, a transparent protection film made of a thermoplastic resin bonded by means of a transparent pressure sensitive adhesive to the printed surface of the card substrate, a cover sheet applied with a lamination film made of a thermoplastic resin different from the thermoplastic resin for the protection film, and a coupling layer made of the same type of thermoplastic resin as that for the lamination film and supplied between the protection film and the lamination film while heated to a temperature within a range from the softening point to the melting point of the resin for releasably coupling the protection film and the lamination film, in which the protection film, the coupling layer and the lamination film are firmly secured with each other at a fixing area of the outer peripheral region and releasing area is formed at other portion of the outer peripheral region.

Since the printed surface of the card substrate is appended with the cover sheet, the printed content thereon can be protected against stealth reading and private or secret items can be printed or written on a postal card.

Further, since the cover sheet is joined by way of the coupling layer to the protection film which is firmly bonded to the card substrate, the cover sheet can firmly be secured to the card substrate without displacing during handling of the card.

Furthermore, since the coupling layer and the protection film are joined merely by the melt-wetting between two different kinds of thermoplastic layers at their boundary, the cover sheet can easily be released, for example, by an addressee from the boundary, and the printed content on the card substrate can be read through the transparent protection film.

The temperature of heating the coupling layer should be lower than the melting point of the thermoplastic resin of the coupling layer. If the temperature is excessively higher, it becomes difficult to release the cover sheet, often leading to the partial tear of the cover sheet of the card substrate itself.

While on the other hand, the temperature should be higher than the softening poing of the thermoplastic resin, because wetting between the coupling layer and the protection film can no more be obtained.

Of course, the temperature is determined depending on the material of the thermoplastic resins, requirement for the sealing strength and combination of the protection film and the coupling layer.

The thermoplastic resin material for the coupling layer should be identical with that for the lamination film and different from that for the protection film.

In a preferred embodiment, the lamination film and the coupling layer are made of polyolefinic resin and the protection film is made of other thermoplastic resin than polyolefinic resin.

In other embodiment, the lamination film and the coupling layer are made of polyethylene type resin and the protection film is made of polyethylene terephthalate type resin.

In a further embodiment the cover sheet is made of paper applied with hiding treatment such as vapor deposition of aluminum.

In a further embodiment the cover sheet is made of a synthetic resin film applied with hiding treatment such as vapor deposition of aluminum.

In a still further embodiment, a cut line is applied at the inside of the fixing area.

DESCRIPTION OF THE ACCOMPANYING DRAWINGS

These and other objects, as well as advantageous features of this invention will become apparent by reading the following descriptions while referring to accompanying drawings, wherein FIG. 1 is a front elevational view partially broken away of a postal card in one embodiment according to this invention;

Explanation of Pseudo-Adhesion

Prior to the description for a preferred embodiment of a postal card according to this invention, brief explanation will be made to the concept of "pseudo-adhesion" which has previously been proposed by the present inventor and is adopted in this invention while referring to a portion of FIG. 3 of the drawings.

Figure 3:
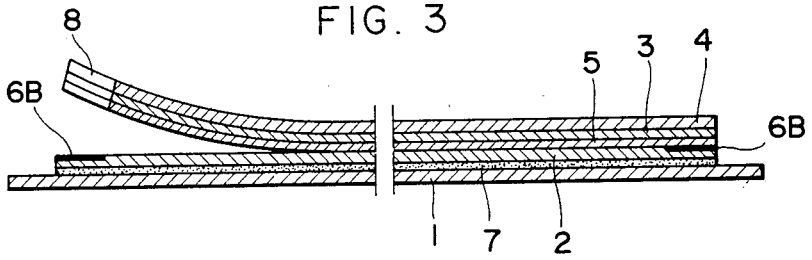
FIG. 3 is a cross sectional view taken along line III—III in FIG. 1.

In FIG. 3, polyethylene resin (hereinafter simply referred to as PE) layer (coupling layer) 5 is supplied between a polyethylene terephthalate (hereinafter simply referred to as PET) film 2 and PE (lamination) film 3 under heating at a temperature below a melting temperature.

The molten PE layer 5 and the PE film 3 are fused to each other integrally at their boundary forming a region comprising crystalline and amorphous portions. While on the other hand, PET film 2 different from the PE layer 5 and having higher melting point remains substantially as it is with no fusion and adheres to the PE layer 5 only by means of "wetting". When the molten PE layer 5 cools to solidifty, the wet boundary between them forms a so-called pseudo-adhesion which shows 180° peeling strength about from 10 to 20 g (at 23° C./65% RH; 500 mm/min; 2 inch width) depending on the temperature applied to the PE layer 5. The pseudo-adhesion is apparently lower than the usual pressure sensitive adhesion of about 800–1000 g/inch but it is strong enough to bring the PET film 2 and the PE lamination film 3 into bonding to each other and keep them from displacing or peeling under usual handling.

Then, if the PET film 2 thus provisionally coupled to the PE lamination film 3 by way of the PE coupling layer 5 is bonded to a paper substrate 1 by means of usual pressure sensitive adhesive 7, a lamination of a structure : PE lamination film 3 - (integral fusion) - PE coupling layer 5 - (psuedo-adhesion) - PET film 2 - (adhesion) - paper substrate 1 is formed.

When the PE lamination film 3 is intended to peel off, the peeling strength alway breaks the most weak pseudo-adhesion between the PE coupling layer 5 and the PET film 2 and the former is peeled off from the latter as shown in the left hand part of FIG. 3.

Such a pseudo-adhesion is utilized in the preferred embodiment of the postal card according to this invention.

DESCRIPTION OF THE PREFERRED EMBODIMENT

Figure 2:
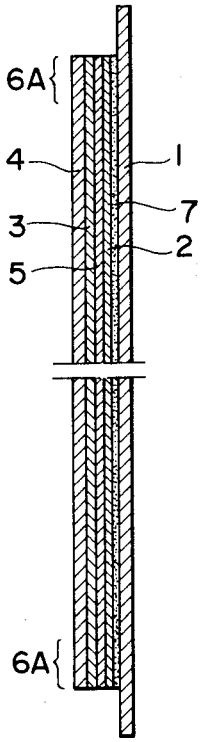
FIG. 2 is a cross sectional view taken along line II—II in FIG. 1.

As shown in FIG. 2, PE lamination film 3 is formed to a thickness of about 25 μm on the rearface of a cover sheet 4 made of high quality paper of about 30 μm thickness vapor deposited with aluminum for hiding power.

Then, polyethylene resin which is the same kind of thermoplastic resin as that of the PE lamination film 3 is heat-extruded between a transparent PET protection film 2 of about 25 μm thickness and the PE lamination film 3 applied on the cover sheet 4 at a temperature slightly lower than its melting point, i.e., about 280° C. and then solidified to form a coupling layer 5.

The PE coupling layer 5 is fused and firmly integrated with the PE lamination film 3 also made of polyethylene upon heat extrusion, whereas it merely forms the "pseudo-adhesion" with the PET protection film 2 made of different thermoplastic resin as described above.

Figure 1:
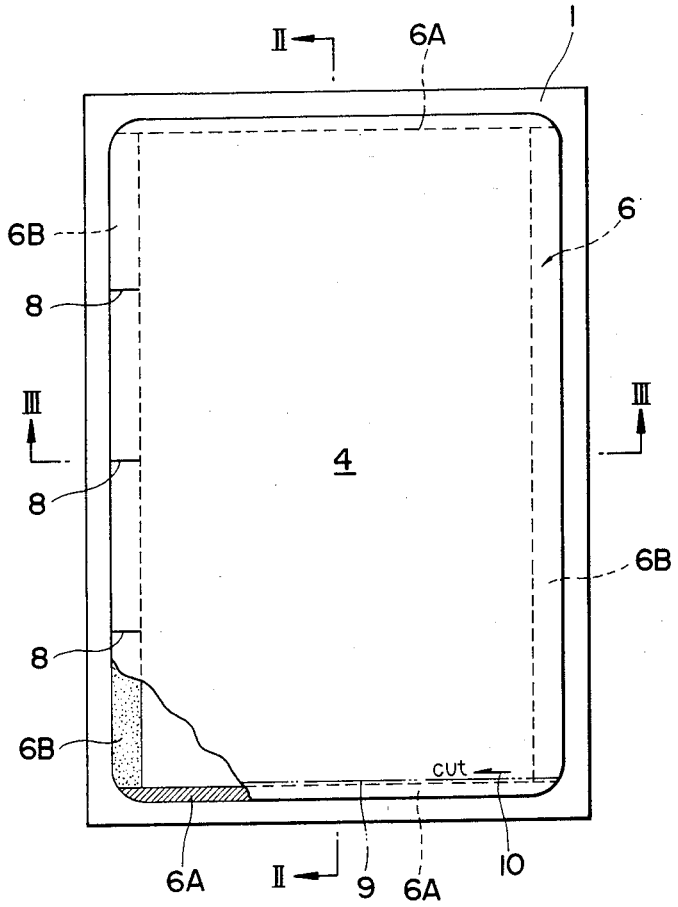

Then, the thus obtained laminated structure comprising the PET protection film 2, PE coupling layer 5 and the cover sheet 4 applied with PE lamination film 3 is cut into an adequate size, that is, slightly smaller than the card substrate 1 and bonded to the surface of the card substrate 1 on which a predetermined content has been printed, by means of a pressure sensitive adhesive 7 as shown in FIGS. 1 and 2.

In this case, the peripheral portion 6 of the PET protection film 2 and the PE lamination film 3 is firmly fixed to each other by previously applying corona discharge treatment, for example, at a fixing area, 6A, 6A in vertically opposed sides. This treatment can enhance the adhesion strength at the peripheral portion 6 where peeling of the cover sheets 4 from the cover substrate 1 (or protection film 2) may occur most possibly.

Further, a releasing area 6B is formed on the PET protection film 2 by applying silicon treatment on both longitudinal sides of the PET protection film 2 as shown in FIG. 1.

In the thus completed postal card, printed contents on the surface of the card substrate 1 is completely concealed by the cover sheet 4 having a high hiding power.

Since the PET protection film 2 is securely bonded to the card substrate 1 and the cover sheet 4 is coupled to this protection film 2 by way of the PE coupling layer 5, the cover sheet 4 does not readily peel off the card substrate 1.

Although, the pseudo-adhesion at the boundary between the PE coupling layer 5 and the PET protection film 2 is as low as 10–20 g by 180° peeling, the cover sheet 4 never displaces relative to the protection film 2 unless plucked at the peripheral edge. Since the upper and lower sides of the cover sheet 4 is tightly secured to the PET protection film 2 by the aid of the corona discharge treatment at the fixing area 6A, 6A, the cover sheet 4 can firmly be attached to the PET protection film 2 and peeling from the edge does not occur substantially.

Upon releasing the cover sheet 4, the lower end of the card is at first cut along the cut line 9 formed to the inside of the lower fixing area 6A, for example, along the arrow 10 shown in FIG. 1 to cut off the fixing area 6A.

Then, the cover sheet 4 is peeled up, for example, at the lower left corner in FIG. 1.

In this case, the strength of the pseudo-adhesion at the boundary between the PET protection film 2 and the PE coupling layer 5 is much weaker than the adhesion of the pressure sensitive adhesive 7 between the card substrate 1 and the protection film 2 as well as than the fusion bond between PE lamination film 3 and the PE coupling layer 5. Accordingly, peeling always occurs between the PET protection film 2 and the PE coupling layer 5 and the cover sheet 4 is surely released together with the PE lamination film 3 and the PE coupling layer 5 while leaving the PET protection film 2 on the card substrate 1.

Then, the printed content on the surface of the substrate can be seen through the transparent protection film 2. If a person should undertake reading of the printed card substrate 1 by stealth, he can not pluck the corona-treated side 6A. Further if he intends to forcively release the cover sheet 4 from the area 6B, the cover sheet 4 will be torn partially at the notch 8 and he can no more recover the original sealed state of the card.

Furthermore, since the printed surface of the card substrate 1 is tightly sealed by the PET protection film 2, there is no worry that important printed information should be polluted or erased during mailing of the post card.

Although this invention has been described referring to a preferred embodiment shown in the appended drawing, various other modifications are of course possible within the scope of this invention.

For example, although the cover sheet 4 is attached substantially over the entire area of the card substrate 1, the sheet 4 may be attached only to a specific portion of the substrate where secret items are printed.

Further, heat-seal treatment may be applied instead of or together with the corona treatment to the fixing area 6A, and the releasing area 6B may be formed at the inside of the fixing area 6A.

The releasing strength for breaking the pseudo-adhesion may optimally be varied depending on the application uses by controlling the extrusion temperature of the coupling layer, proper selection for the combination of the resin material for the protection film and the coupling layer etc.

Furthermore, although this invention has been described for postal cards, it may be applied for various other cards such as greeting cards, gift cards, etc.

What is claimed is:

1. A postal card having a cover sheet releasably bonded to the printed surface of a card substrate, comprising:

a card substrate 1 on which secret contents are printed, a transparent protection film 2 made of a thermoplastic resin bonded by means of a transparent pressure sensitive layer 7 to the printed surface of said card substrate 1, a cover sheet 4 applied with a lamination film 3 made of a thermoplastic resin different from the thermoplastic resin for said protection film 2, and a coupling layer 5 made of the same kind of the thermoplastic resin as that for said lamination film 3 and supplied between the protection film 2 and the lamination film 3 while heated to a temperature within a range from the softening point to the melting point of said resin for releasably coupling the protection film 2 and the lamination film 3, in which said protection film 2, said coupling layer 5 and said lamination film 3 are firmly secured with each other at least at a fixing area 6A of the outer peripheral region 6 and releasing area 6B is formed at another portion of said outer peripheral region 6.

2. A postal card as defined in claim 1, wherein the lamination film and the coupling layer are made of polyolefinic resin and the protection film is made of other thermoplastic resin than the polyolefinic resin.

3. A postal card as defined in claim 1, wherein the lamination film and the coupling layer are made of a polyethylene resin and the protection film is made of polyethylene terephthalate resin.

4. A postal card as defined in claim 1, wherein the cover sheet 4 is made of paper applied with hiding treatment such as vapor deposition of aluminum.

5. A postal card as defined in claim 1, wherein the cover sheet 4 is made of a synthetic resin film applied with hiding treatment such as vapor deposition of aluminum.

6. A postal card as defined in claim 1, wherein the protection film 2, the lamination film 3 and the coupling layer 5 are firmly secured each other by the aid of corona discharge treatment at the fixing area 6A.

7. A postal card as defined in claim 1, wherein the releasing area 6B is formed by applying silicon treatment.

8. A postal card as defined in claim 1, wherein a cut line is applied at the inside of the fixing area 6A.

* * * * *